US008287044B2

(12) United States Patent
Chen et al.

(10) Patent No.: US 8,287,044 B2
(45) Date of Patent: Oct. 16, 2012

(54) HIGHCHAIR

(75) Inventors: Hong-Bo Chen, Taipei (TW); Xiao-Long Mo, Taipei (TW); Fu-Sian Yu, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 408 days.

(21) Appl. No.: 12/555,815

(22) Filed: Sep. 9, 2009

(65) Prior Publication Data

US 2010/0060059 A1 Mar. 11, 2010

Related U.S. Application Data

(60) Provisional application No. 61/095,628, filed on Sep. 10, 2008, provisional application No. 61/109,495, filed on Oct. 29, 2008.

(51) Int. Cl.
*A47C 1/00* (2006.01)

(52) U.S. Cl. ..... 297/327; 297/326; 297/328; 297/131

(58) Field of Classification Search ..... 297/326–328, 297/131

See application file for complete search history.

(56) References Cited

U.S. PATENT DOCUMENTS

| | | | | | |
|---|---|---|---|---|---|
| 628,166 | A * | 7/1899 | Sheridan | 297/118 |
| 2,779,389 | A * | 1/1957 | Pearl | 297/327 |
| 4,790,599 | A * | 12/1988 | Goldman | 297/327 |
| 6,161,898 | A * | 12/2000 | Brevi | 297/328 |
| 6,325,455 | B1 * | 12/2001 | Chung | 297/327 |
| 6,347,833 | B1 | 2/2002 | Chen | |
| 6,398,304 | B1 * | 6/2002 | Chen et al. | 297/327 |
| 7,100,988 | B1 | 9/2006 | Hyslop | |
| 7,905,549 | B2 * | 3/2011 | Lake et al. | 297/344.19 |
| 2007/0080567 | A1 | 4/2007 | Konig | |

FOREIGN PATENT DOCUMENTS

| | | | |
|---|---|---|---|
| DE | 201 00 084 | U1 | 5/2001 |
| DE | 696 13 519 | T2 | 10/2001 |
| EP | 0 228 158 | A2 | 7/1987 |
| EP | 0 228 158 | A3 | 7/1987 |
| EP | 0755642 | A1 | 1/1997 |
| FR | 2 733 132 | | 10/1996 |
| GB | 2358793 | A | 8/2001 |
| GB | 2 375 956 | | 12/2002 |

* cited by examiner

*Primary Examiner* — Laurie Cranmer
(74) *Attorney, Agent, or Firm* — Winston Hsu; Scott Margo

(57) ABSTRACT

A highchair includes a seat frame, a first fixing socket disposed on the seat frame, and a seat pivotally connected to the first fixing socket. The first fixing socket has a sliding groove and a first engaging groove. The sliding groove communicates with the first engaging groove. The highchair includes a pivoting member, a restraining member, a connecting member, an adjusting member and a fixing member. The adjusting member is movably disposed on the seat. The fixing member is rotatably disposed on the seat and capable of selectively locking or releasing the adjusting member. The pivoting member is pivotally connected to one side of the seat. One end of the connecting member is connected to the pivoting member and the other end is connected to the adjusting member. The restraining member is disposed at one end of the pivoting member and movably engaged with the first engaging groove.

18 Claims, 20 Drawing Sheets

HIGHCHAIR

CROSS REFERENCE TO RELATED APPLICATIONS

This application claims the benefits of U.S. Provisional Applications No. 61/095,628, which was filed on Sep. 10, 2008 and No. 61/109,495, which was filed on Oct. 29, 2008, and are incorporated herein by reference.

BACKGROUND OF THE INVENTION

1. Field of the Invention

The invention relates to a highchair and, more particularly, to a highchair with multiple functions, such as seat swing, seat bouncing and/or seat tilt angle adjusting function(s).

2. Description of the Prior Art

Parent or care giver usually uses a highchair to secure infant or child while dining. Most of the conventional highchairs only have a dining plate or an attached toy for comforting the infant or child or just provide function of adjusting height of seat. Once the infant or child has to be taken care of by somebody while dining, the highchair should be replaced by other devices, such as a crib or other swing devices. However, no matter what manner the infant or child stays in those devices, there is always a specific distance or height between the infant or child and the care giver. Accordingly, it is very inconvenient for the care giver. Therefore, the highchair is still the best choice for securing the infant or child while dining.

During dining, the infant or child may feel sleepy due to tiredness or get impatient after sitting too long. At this time, the care giver has to hold the infant or child in the arms to pacify him or her. However, when the infant or child is taken away from or put back to the highchair, he or she is often disturbed at the same time, so as to make him or her feel uncomfortable.

Therefore, besides securing the infant or child during dining, the highchair should still have the function of pacifying him or her or seating him or her at appropriate position, so as to solve the aforesaid problems.

SUMMARY OF THE INVENTION

An objective of the invention is to provide a highchair with multiple functions, such as seat swing, seat bouncing and/or seat tilt angle adjusting function(s).

According to one embodiment of the invention, a highchair comprises a seat, a seat frame and a first fixing socket. The first fixing socket is disposed on the seat frame and the seat is pivotally connected to the first fixing socket. The first fixing socket has a sliding groove and a first engaging groove and the sliding groove communicates with the first engaging groove. The highchair comprises a pivoting member, a restraining member, a connecting member, an adjusting member and a fixing member. The adjusting member is movably disposed on the seat. The fixing member is rotatably disposed on the seat and capable of selectively locking or releasing the adjusting member. The pivoting member is pivotally connected to one side of the seat. A first end of the connecting member is connected to the pivoting member and a second end of the connecting member is connected to the adjusting member. The restraining member is disposed at one end of the pivoting member and movably engaged with the first engaging groove. When the adjusting member is pulled, the adjusting member drives the connecting member to pull the pivoting member and then the pivoting member rotates with respect to the seat, so as to drive the restraining member to move from the first engaging groove to the sliding groove. When the restraining member is disengaged from the first engaging groove and the fixing member locks the adjusting member, the restraining member is capable of sliding within the sliding groove, such that the seat is capable of swinging with respect to the seat frame.

The adjusting member has a first fixing portion, the fixing member has a second fixing portion, and the second fixing portion is capable of being fixed to or released from the first fixing portion.

The first fixing socket has a second engaging groove communicating with the sliding groove, and the restraining member is able to move from the first engaging groove and the sliding groove to the second engaging groove by operating the adjusting member.

The highchair may further comprise a first resilient member disposed between the seat and the pivoting member. When the adjusting member is released, the first resilient member provides an elastic force for the pivoting member, such that the pivoting member drives the restraining member to move toward the first or second engaging groove.

A first included angle is between an extended direction of an opening of the first engaging groove and a horizontal line, a second included angle is between an extended direction of an opening of the second engaging groove and a horizontal line, and the first included angle is different from the second included angle.

The highchair may further comprise a torsion spring disposed on the first fixing socket, wherein a first end of the torsion spring abuts against the first fixing socket and a second end of the torsion spring abuts against the seat.

The seat has a restraining groove and one end of the restraining member is movably disposed in the restraining groove.

The highchair may further comprise a second resilient member and a locking member disposed on one side of the seat. The locking member is movably disposed in a recess of the first fixing socket. When the locking member protrudes from the recess, one end of the second resilient member abuts against the locking member, such that the second resilient member provides an elastic force for bouncing the seat.

The locking member has a plurality of abutting portions. When the seat is situated at one position relative to the seat frame, one end of the second resilient member abuts against one of the abutting portions.

The highchair may further comprise a bottom plate and a third resilient member. The bottom plate is disposed below the seat, the third resilient member is disposed between the seat and the bottom plate, and the third resilient member provides an elastic force for bouncing the seat.

The highchair may further comprise a second fixing socket and a driving mechanism. The second fixing socket is disposed on one side of the seat frame and opposite to the first fixing socket. The seat is pivotally connected to the driving mechanism. The driving mechanism is disposed in the second fixing socket. When the restraining member is disengaged from the first engaging groove and the fixing member locks the adjusting member, the driving mechanism is capable of driving the seat to swing with respect to the seat frame.

The second fixing socket has an accommodating space. The driving mechanism comprises a power supply unit, a cover and a driving device. The power supply unit and the driving device are disposed in the accommodating space, and the cover detachably covers the accommodating space.

The driving device comprises a motor, a flywheel, a worm shaft, a worm gear, a linking rod, a friction member, a rubber member and a rivet member. An output axle of the motor is connected to the flywheel. The flywheel is connected to the worm shaft. The worm shaft is connected to the worm gear. A first end of the linking rod is connected to the worm gear and a second end of the linking rod is connected to the friction member. The seat is pivotally connected to the second fixing socket by the rivet member. The friction member and the rubber member are disposed on the rivet member. The friction member contacts the rubber member tightly and the rubber member contacts the seat tightly.

The driving device comprises a fourth resilient member disposed between the second fixing socket and the friction member. The fourth resilient member provides an elastic force for making the friction member contact the rubber member tightly.

The driving device comprises a switch and the switch having an operating portion exposed out of the second fixing socket.

According to the aforesaid embodiments, the highchair of the invention has the following advantages and useful effects. The adjusting member can be operated to make the restraining member selectively engage with the first or second engaging groove, so as to adjust the tilt angle of the seat. Furthermore, when the restraining member is disengaged from the first or second engaging groove and the fixing member locks the adjusting member, the restraining member can slide within the sliding groove, such that the seat can swing with respect to the seat frame. It should be noted that the seat can be swung manually or automatically by the driving device. Moreover, the second or third resilient member can provide elastic force for bouncing the seat. Therefore, the highchair of the invention can perform multiple functions, such as seat swing, seat bouncing and/or seat tilt angle adjusting function (s), so as to pacify an infant or child or seat him or her at appropriate position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
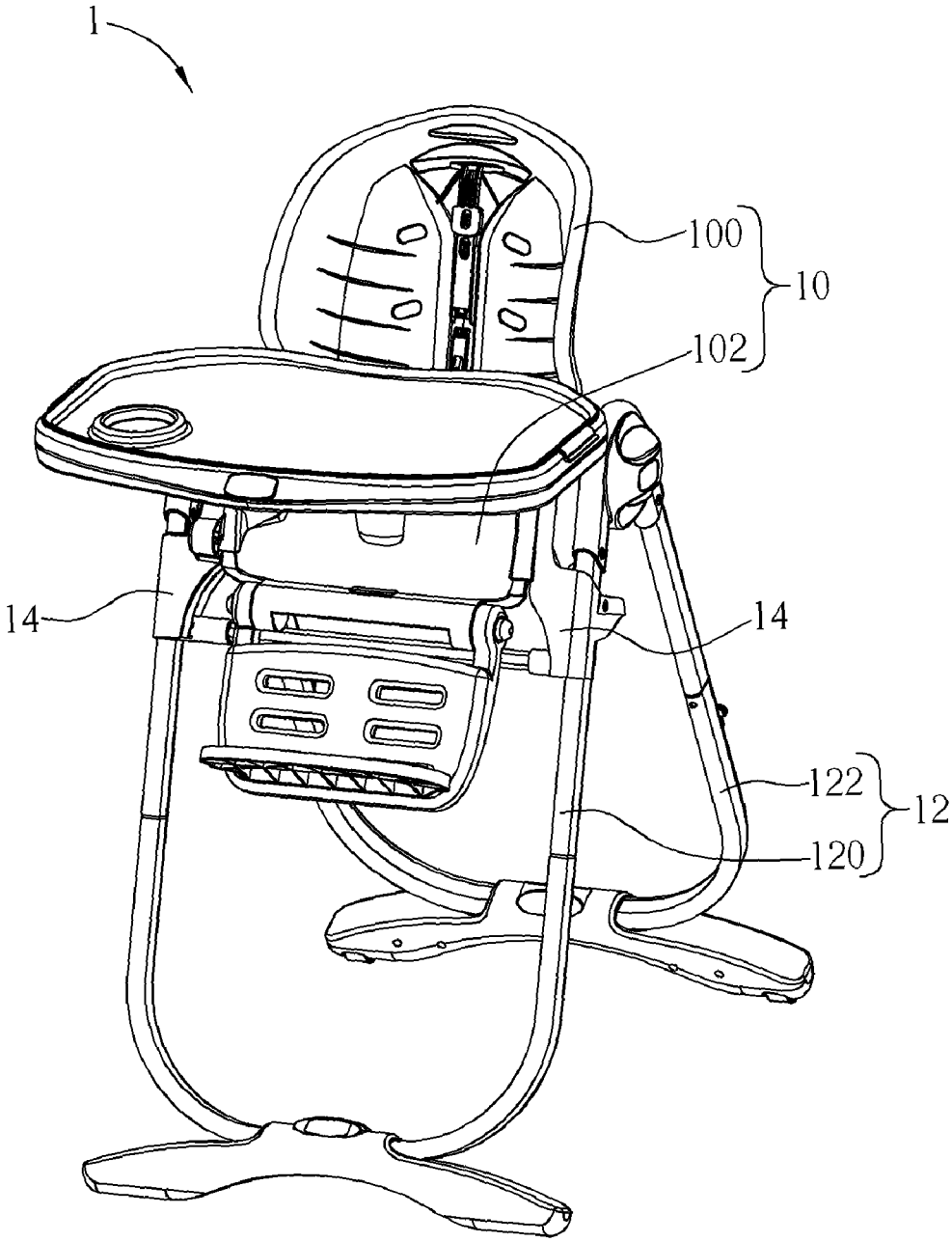
FIG. 1 is a perspective view illustrating a highchair according to one embodiment of the invention.

As shown in FIG. 1, a highchair 1 comprises a seat 10, a seat frame 12 and two first fixing sockets 14. The seat 10 comprises a backrest 100 and a seat plate 102. In this embodiment, the backrest 100 and the seat plate 102 are formed integrally. The seat frame 12 comprises a front leg assembly 120 and a rear leg assembly 122. The front leg assembly 120 is pivotally connected to the rear leg assembly 122, such that the front leg assembly 120 can be closed or opened with respect to the rear leg assembly 122. The two first fixing sockets 14 are disposed on opposite sides of the seat frame 12 respectively. Both sides of the seat 10 are pivotally connected to the two first fixing sockets 14 by rivets or other pivoting components.

Figure 2:
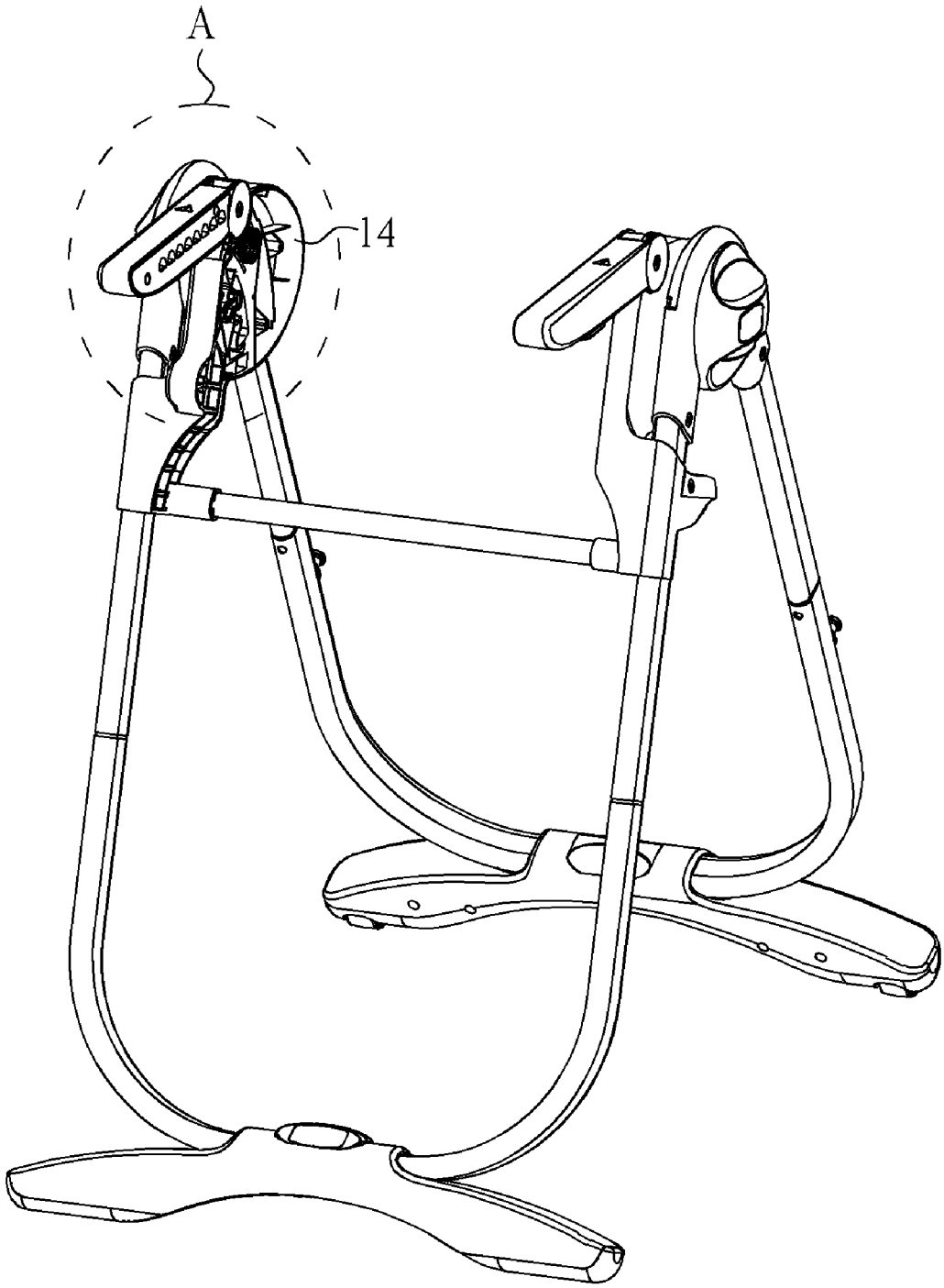
FIG. 2 is perspective view illustrating the highchair shown in FIG. 1 without the seat.
Figure 3:
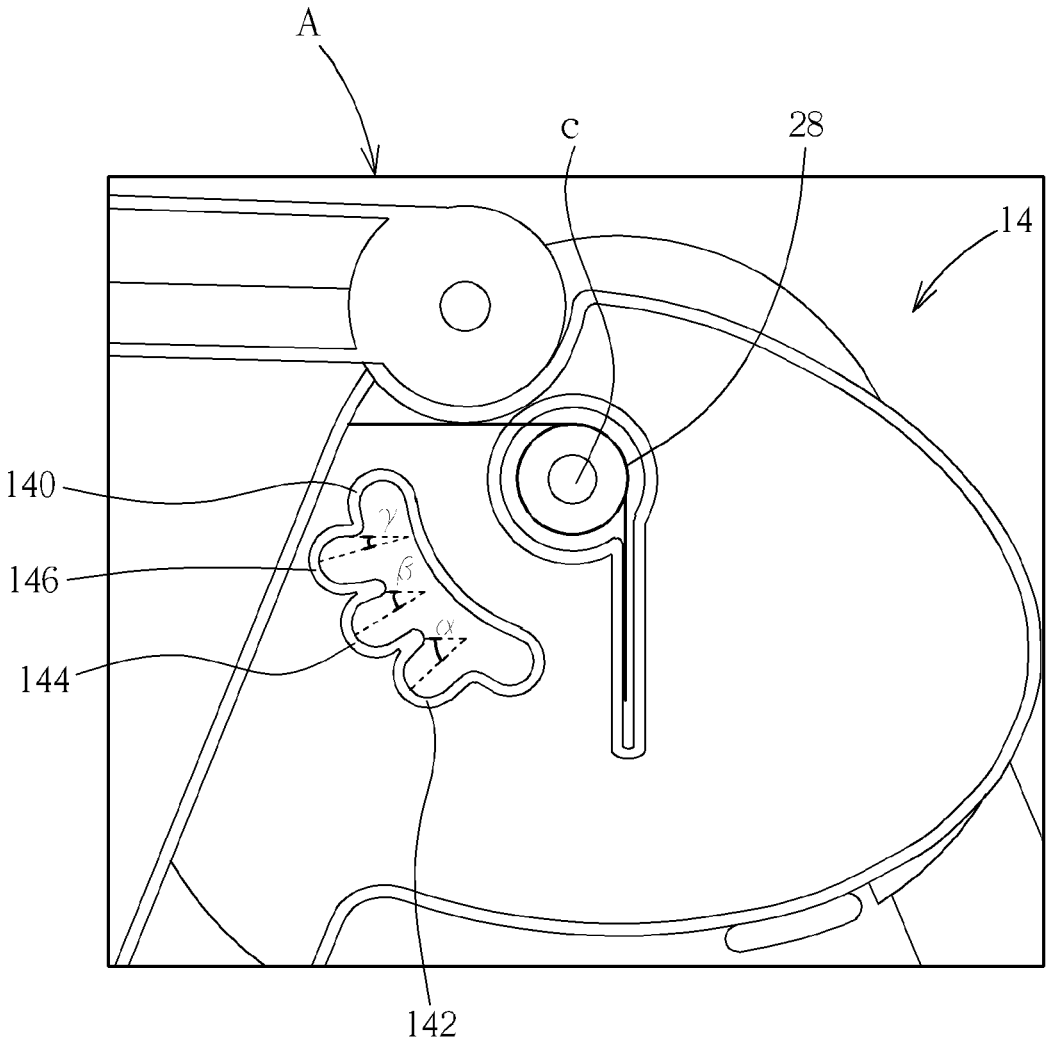
FIG. 3 is an enlarged view illustrating the area A shown in FIG. 2.

As shown in FIGS. 2 and 3, the first fixing socket 14 has a sliding groove 140, a first engaging groove 142, a second engaging groove 144 and a third engaging groove 146. The sliding groove 140 communicates with the first, second and third engaging grooves 142, 144 and 146. It should be noted that the number of the engaging grooves can be designed based on practical applications and is not limited to the structure shown in FIG. 2. Furthermore, a first included angle $\alpha$ is between an extended direction of an opening of the first engaging groove 142 and a horizontal line, a second included angle $\beta$ is between an extended direction of an opening of the second engaging groove 144 and a horizontal line, a third included angle $\gamma$ is between an extended direction of an opening of the third engaging groove 146 and a horizontal line, and the first, second and third included angles $\alpha$, $\beta$ and $\gamma$ are different from each other.

Figure 4:
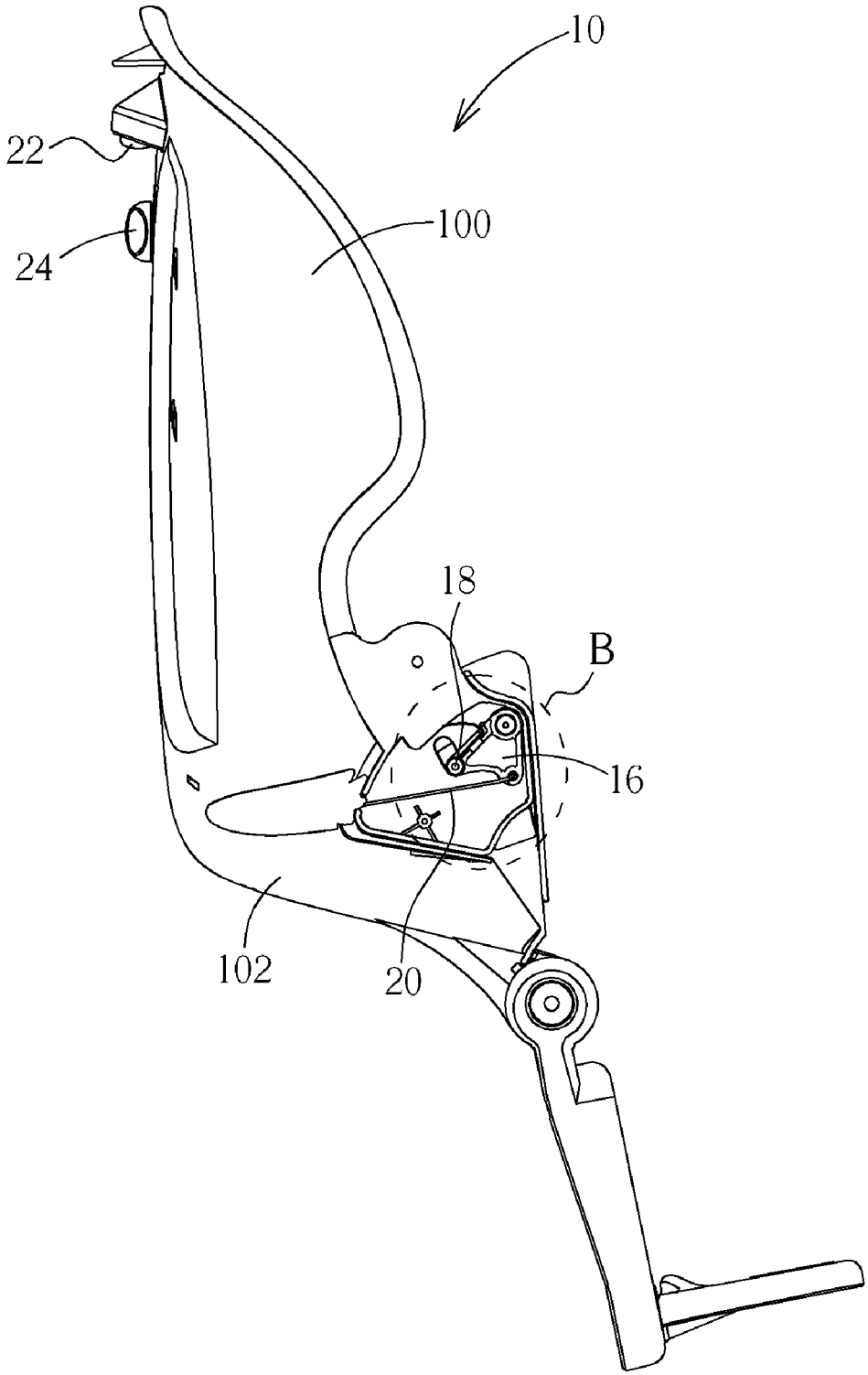
FIG. 4 is a side view illustrating the seat shown in FIG. 1.
Figure 5:
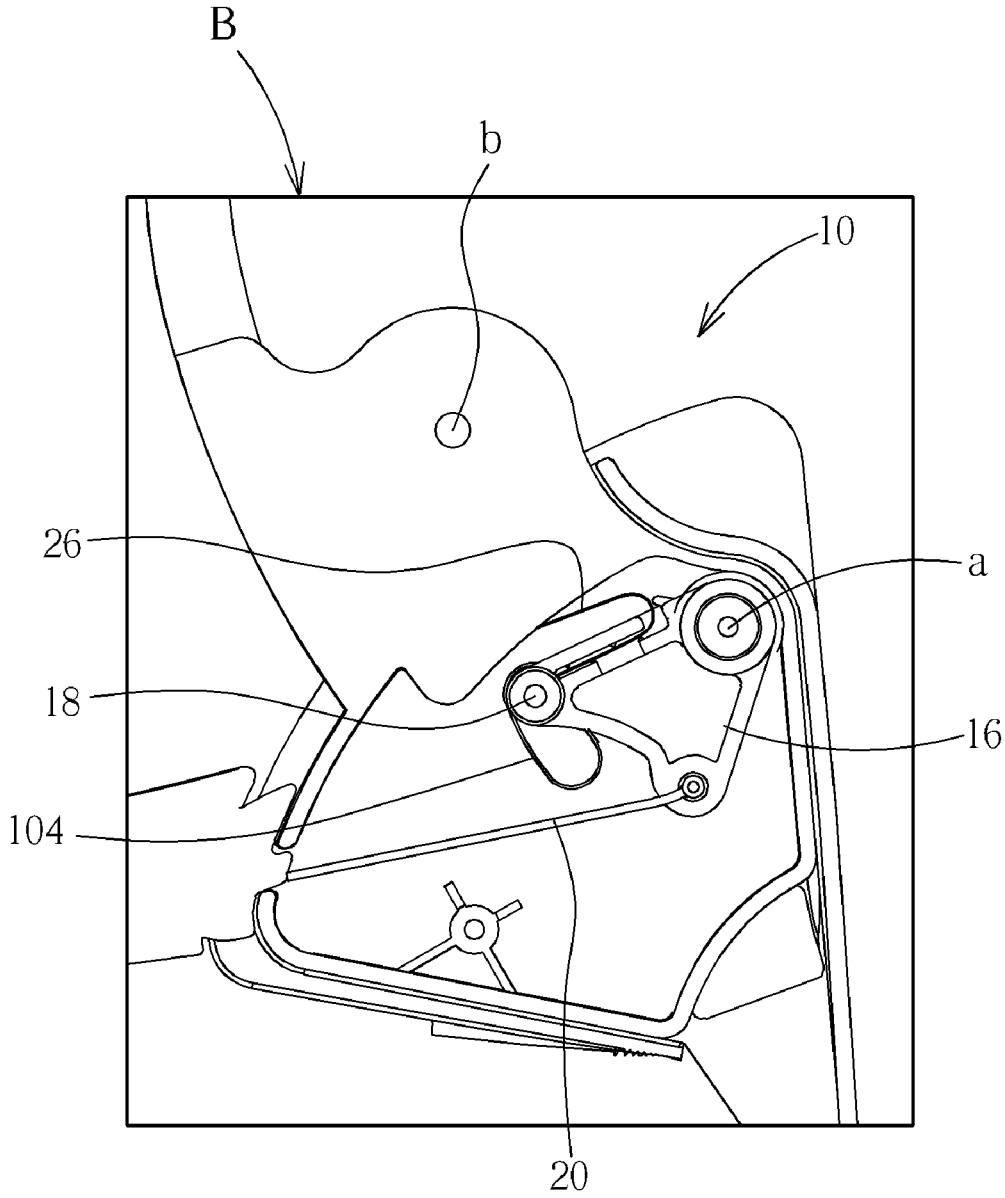
FIG. 5 is an enlarged view illustrating the area B shown in FIG. 4.
Figure 6:
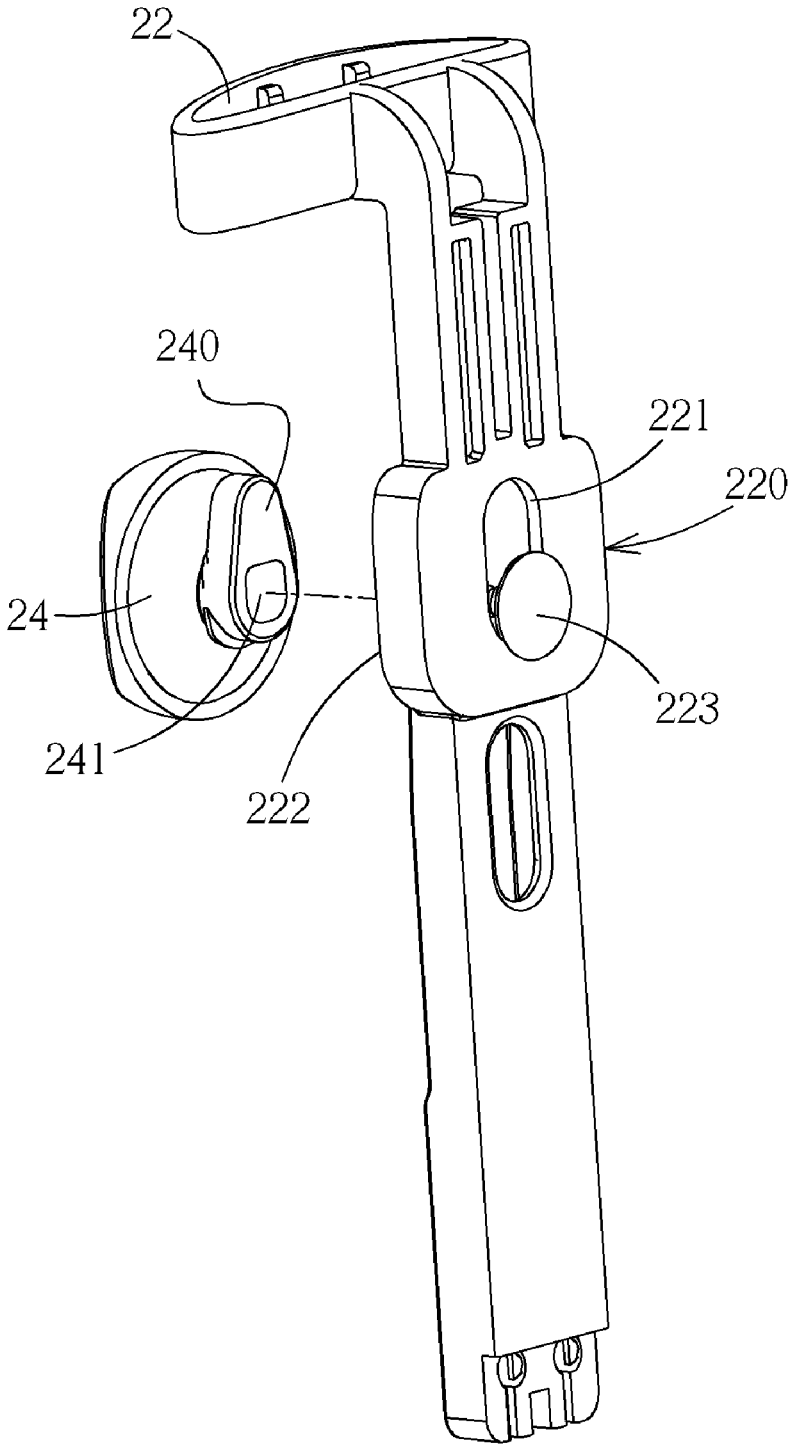
FIG. 6 is a perspective view illustrating the adjusting member and the fixing member shown in FIG. 4.

As shown in FIGS. 4 to 6, the highchair 1 comprises a pivoting member 16, a restraining member 18, a connecting member 20, an adjusting member 22, a fixing member 24 and a first resilient member 26. The adjusting member 22 is movably disposed on the backrest 100 of the seat 10. The fixing member 24 is rotatably disposed on the seat 10. In this embodiment, the adjusting member 22 can be a handle and the fixing member 24 can be a rotating button. As shown in FIG. 6, the adjusting member 22 has a first fixing portion 220 and the fixing member 24 has a second fixing portion 240 (as the protruding block shown in FIG. 6). The first fixing portion has a longitudinal groove 221 and an engaging structure (not shown) formed on a surface 222 opposite to the second fixing portion 240. The second fixing portion 240 can be selectively engaged with or released from the engaging structure. Furthermore, the second fixing portion 240 has a pivoting hole 241. A pivoting member 223 can pass through the backrest 100 of the seat 10 and the longitudinal groove 221 and then be pivotally connected to the pivoting hole 241, such that the fixing member 24 can be disposed on the seat 10 and pivot the pivoting member 223. A user can rotate the fixing member 24 to make the second fixing portion 240 be engaged with or released from the first fixing portion 220. In other words, the fixing member 24 can be operated by the user so as to selectively lock or release the adjusting member 22. As shown in FIG. 5, the pivoting member 16 is pivotally connected to a pivoting point a on one side of the seat 10. One end of the connecting member 20 is connected to the pivoting member 16 and the other end is connected to the adjusting member 22. In this embodiment, the connecting member 20 can be a steel wire. The first resilient member 26 is disposed between the seat 10 and the pivoting member 16. In this embodiment, the first resilient member 26 can be an elastic plate or a spring. The restraining member 18 is disposed at one end of the pivoting member 16. In this embodiment, the restraining member 18 can be a pin which has one end movably disposed in a restraining groove 104 of the seat 10, so the restraining member 18 can only be moved within the restraining groove 104 when the pivoting member 16 rotates with respect to the seat 10.

Figure 7:
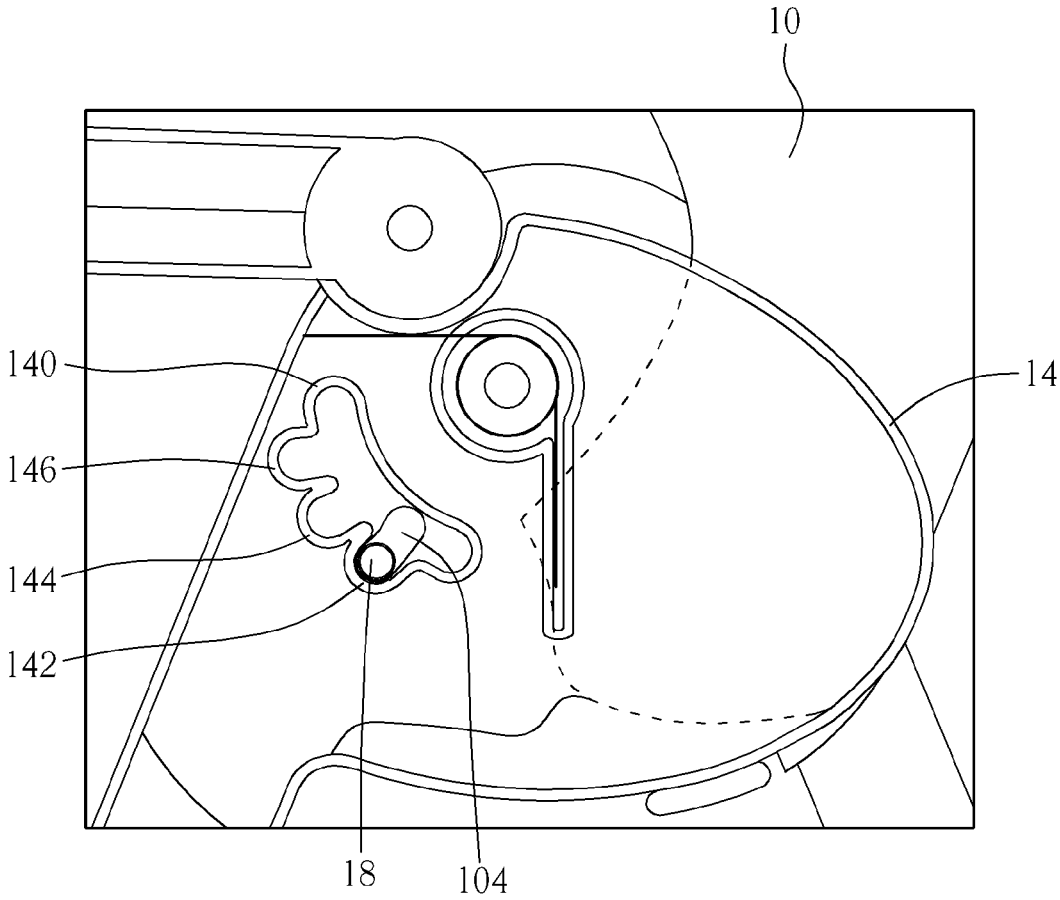
FIG. 7 is a perspective view illustrating the seat shown in FIG. 5 pivotally connected to the first fixing socket shown in FIG. 3.
Figure 8:
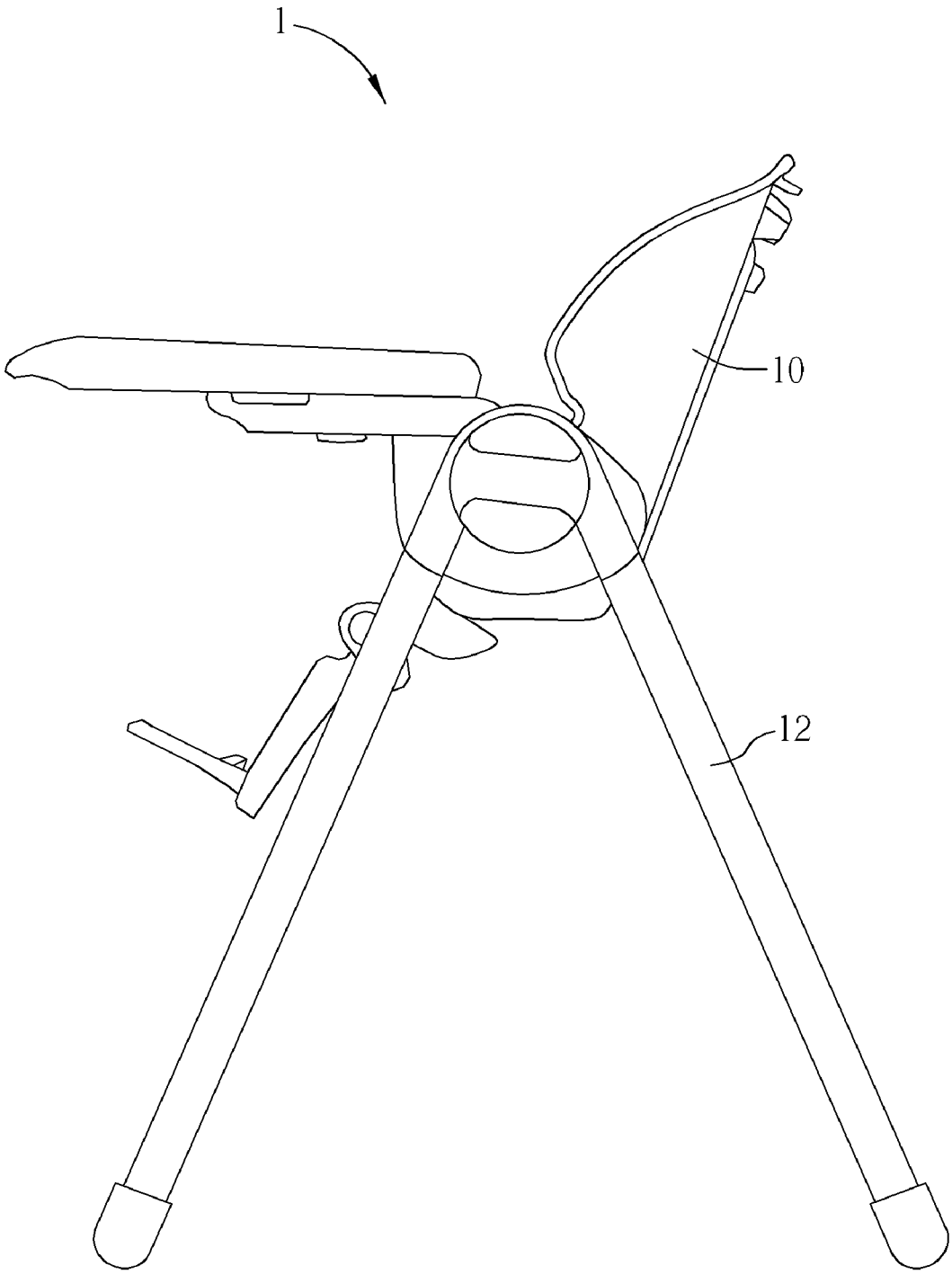
FIG. 8 is a side view illustrating the seat located at a position relative to the seat frame while the restraining member is engaged with the first engaging groove.

When a pivoting point b of seat 10 (as shown in FIG. 5) is pivotally connected to a pivoting point c of the first fixing socket 14 (as shown in FIG. 3) and the adjusting member 22 does not be pulled yet, one end of the restraining member 18 is engaged with the first engaging groove 142, as shown in FIG. 7. At this time, the position of the seat 10 of the highchair 1 relative to the seat frame 12 is shown in FIG. 8. Since the restraining member 18 is engaged with the first engaging groove 142, the seat 10 is situated at a static state relative to the seat frame 12.

When a user wants to swing the seat 10 of the highchair 1, he or she has to pull the adjusting member 22 upwardly with respect to the backrest 100 of the seat 10. When the adjusting member 22 is pulled, the adjusting member 22 drives the connecting member 20 to pull the pivoting member 16 and then the pivoting member 16 rotates with respect to the seat 10, so as to move the restraining member 18 which has one end disposed in the restraining groove 104 from the first engaging groove 142 to the sliding groove 140. At the same time, the pulled pivoting member 16 will compress the first resilient member 26. When the restraining member 18 is disengaged from the first engaging groove 142, the user has to rotate the fixing member 24 to engage with the adjusting member 22. At this time, the restraining member 18 can slide within the sliding groove 140. Consequently, the seat 10 can be swung with respect to the seat frame 12. When the user wants to keep the seat 10 of the highchair 1 at a static state, he or she only has to rotate the fixing member 24 to release the engagement with the adjusting member 22. Afterward, the compressed first resilient member 26 will provide an elastic force for the pivoting member 16, such that the pivoting member 16 drives the restraining member 18 to move toward the first, second or third engaging groove 142, 144 or 146. Accordingly, the restraining member 18 is engaged with the first, second or third engaging groove 142, 144 or 146.

Figure 9:
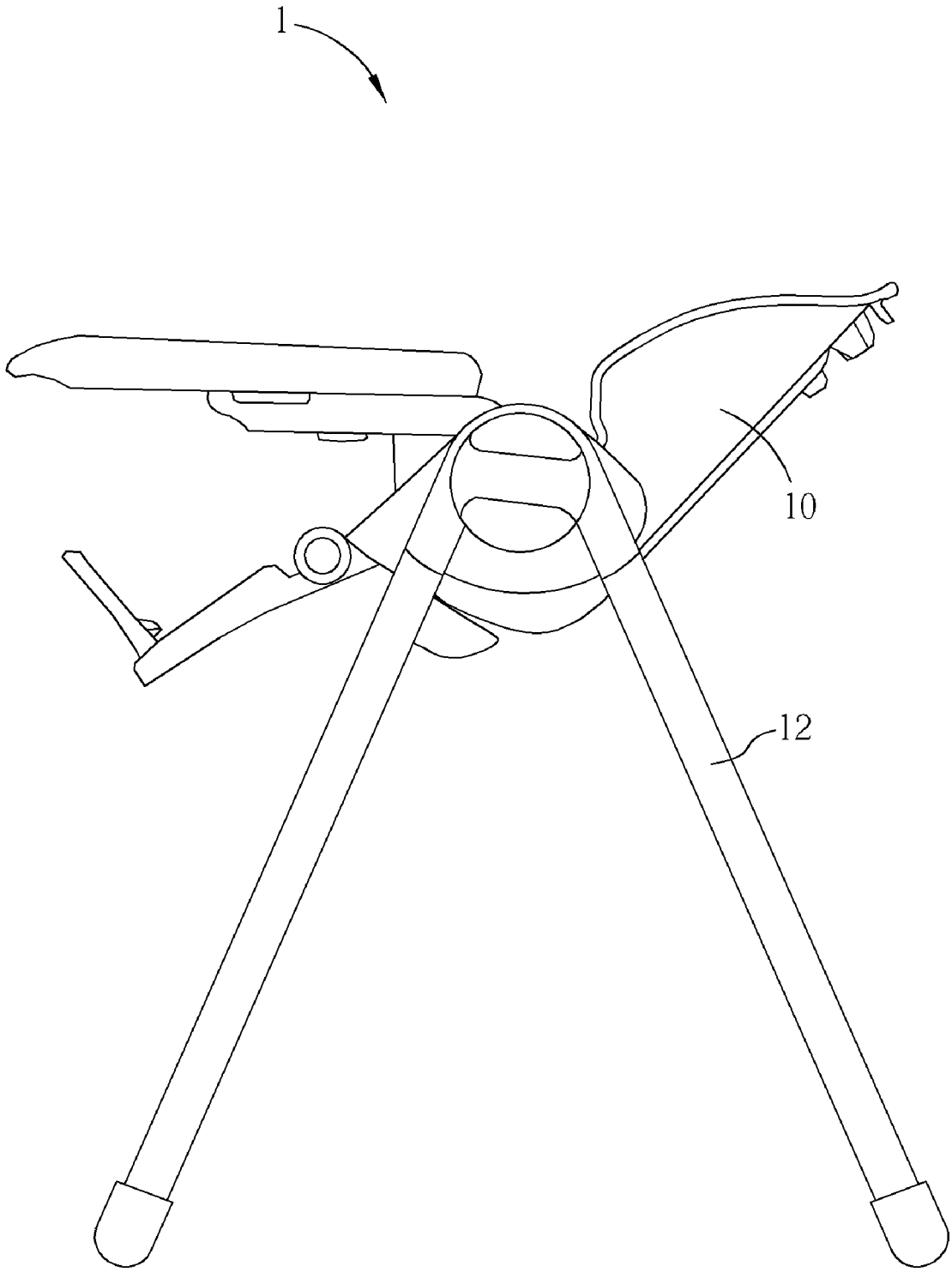
FIG. 9 is a side view illustrating the seat located at a position relative to the seat frame while the restraining member is engaged with the third engaging groove.

Besides the aforesaid function of swing seat, the highchair 1 of the invention further has a function of adjusting seat tilt angle. When the user wants to adjust the tilt angle of the seat 12 relative to the seat frame 10, he or she has to pull the adjusting member 22 upwardly with respect to the backrest 100 of the seat 10. When the adjusting member 22 is pulled, the adjusting member 22 drives the connecting member 20 to pull the pivoting member 16 to rotate with respect to the seat 10 which moves the restraining member 18 from the first engaging groove 142 to the sliding groove 140 and makes the pivoting member 16 to compress the first resilient member 26. At this time, since the restraining member 18 can slide within the sliding groove 140, the user can adjust the seat 10 to a desired angle (e.g. the angle corresponding to the second or third engaging groove 144 or 146) and then releases the adjusting member 22. Afterward, the compressed first resilient member 26 will provide an elastic force for the pivoting member 16, such that the pivoting member 16 drives the restraining member 18 to move toward the second or third engaging groove 144 or 146. Accordingly, the restraining member 18 is engaged with the second or third engaging groove 144 or 146. When the restraining member 18 is engaged with the first engaging groove 142, the position of the seat 10 of the highchair 1 relative to the seat frame 12 is shown in FIG. 8. When the restraining member 18 is engaged with the third engaging groove 146, the position of the seat 10 of the highchair 1 relative to the seat frame 12 is shown in FIG. 9.

Figure 10:
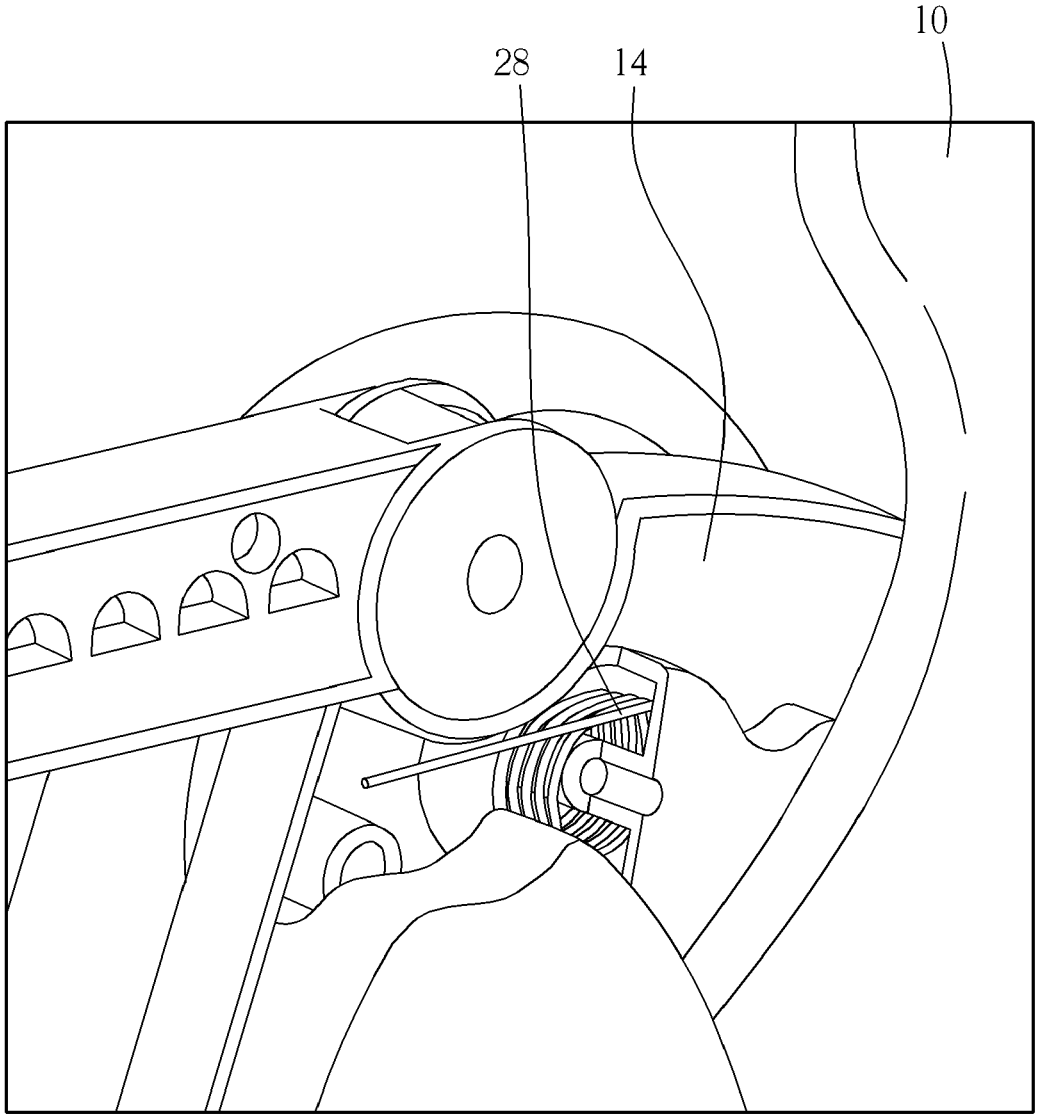
FIG. 10 is a schematic diagram illustrating one of the first fixing sockets equipped with a torsion spring.
Figure 11:
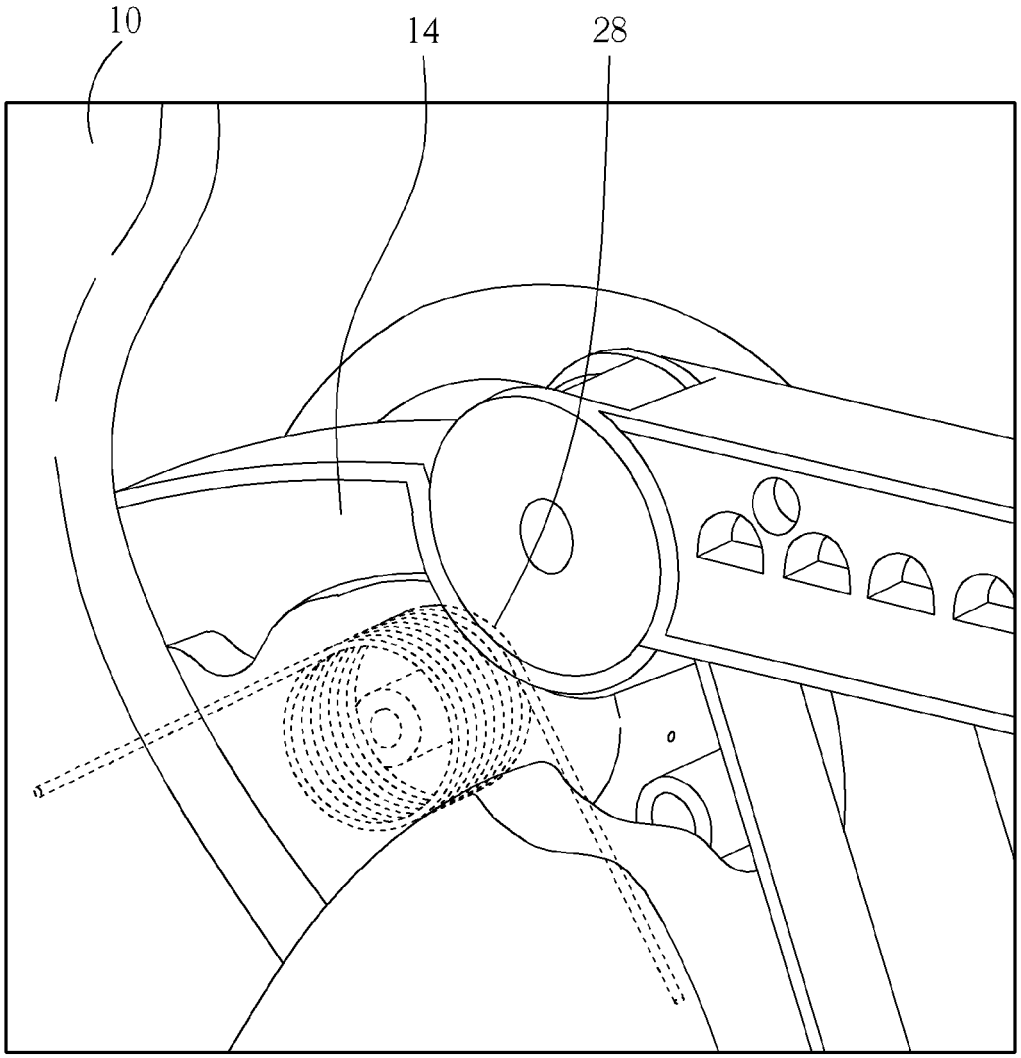
FIG. 11 is a schematic diagram illustrating the other one of the first fixing sockets equipped with a torsion spring.

As shown in FIGS. 10 and 11, the highchair 1 comprises two torsion springs 28, which are disposed in the first fixing sockets 14 on opposite sides of the seat frame 12. One end of the torsion 28 abuts against the first fixing socket 14 and the other end abuts against the seat 10. In this embodiment, the two torsion springs 28 on both sides are arranged reversely to push the seat 10 in opposite direction. Accordingly, the seat 10 can swing back and forth due to the interaction between the two torsion springs 28. Also, the two torsion springs can assist the seat 10 in keeping the center of gravity.

Figure 12:
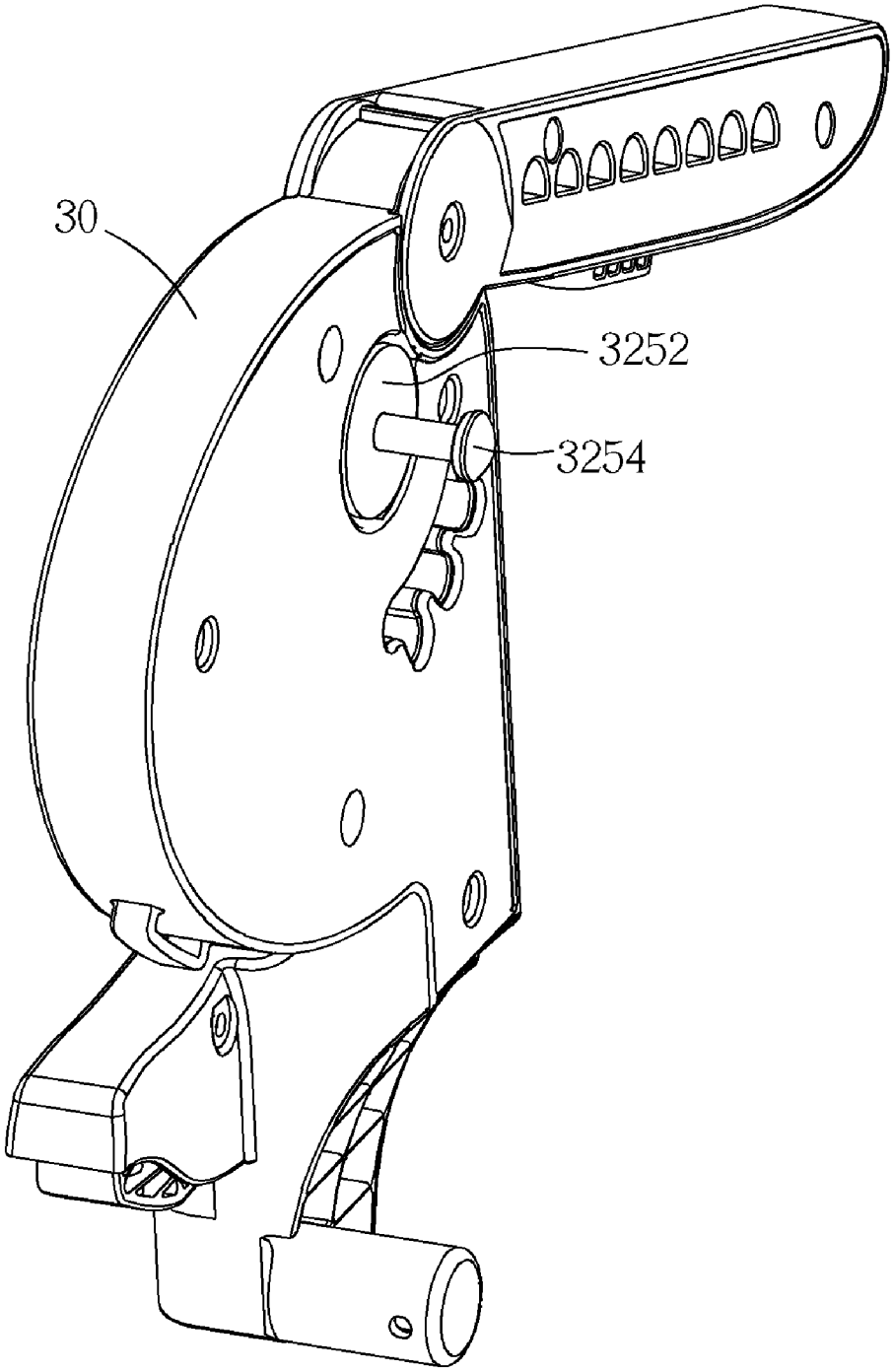
FIG. 12 is a perspective view illustrating a second fixing socket according to another embodiment of the invention.
Figure 13:
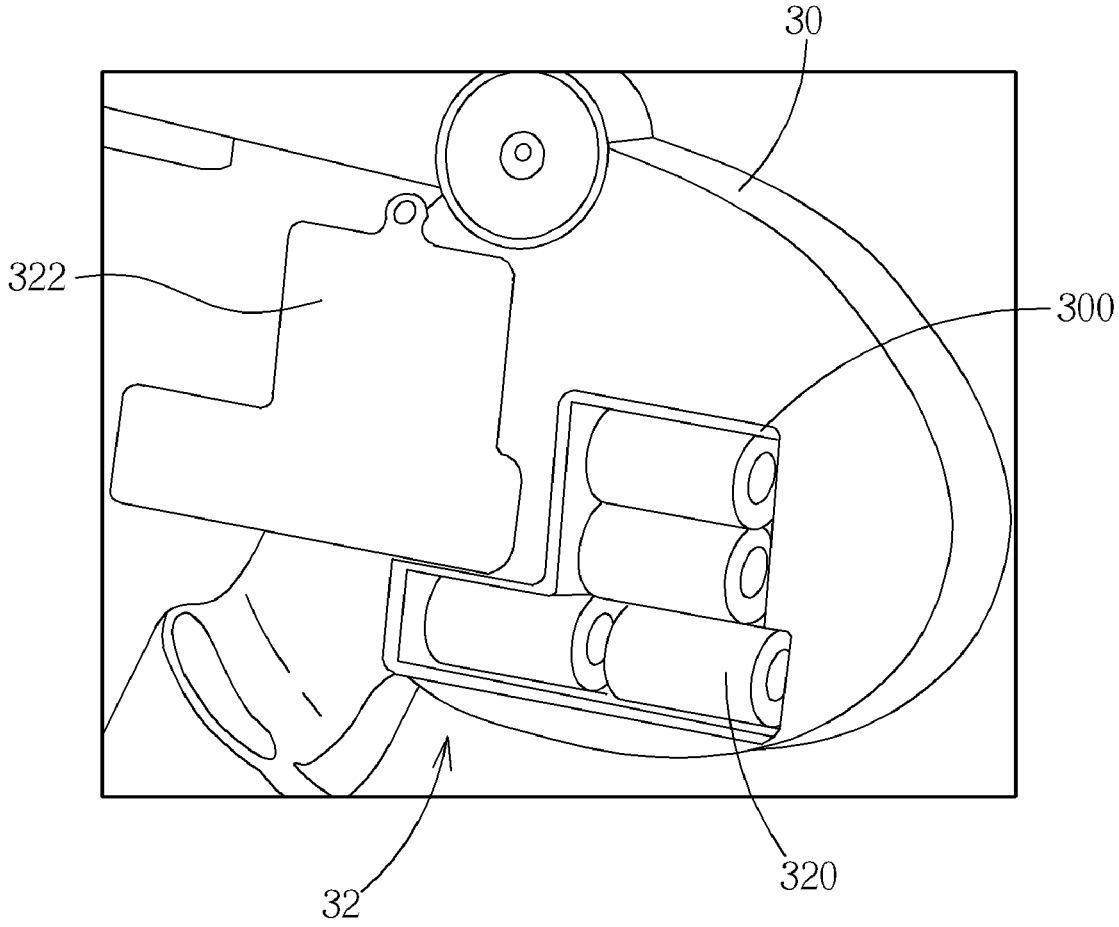
FIG. 13 is a perspective view illustrating the driving mechanism and the second fixing socket.
Figure 14:
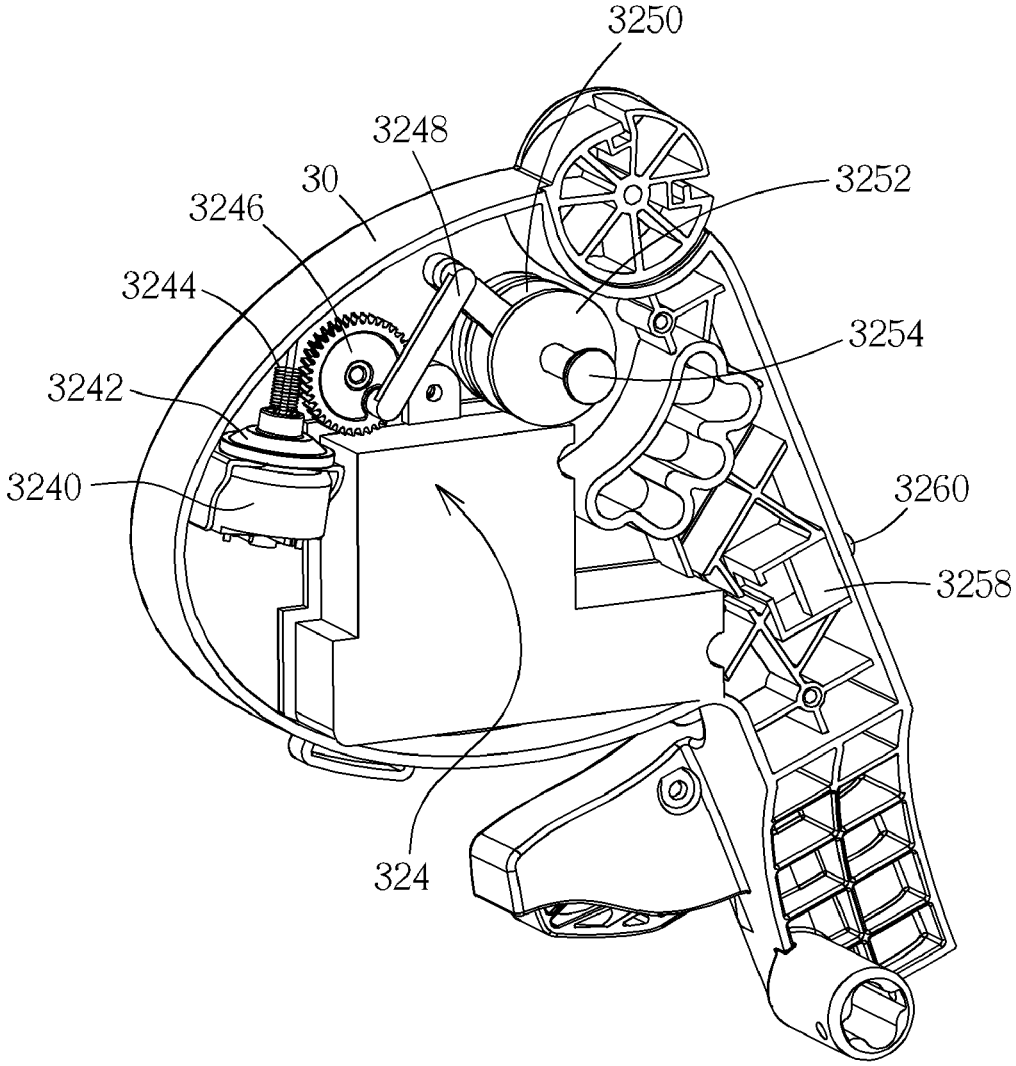
FIG. 14 is a perspective view illustrating the driving device disposed in the second fixing socket.
Figure 15:
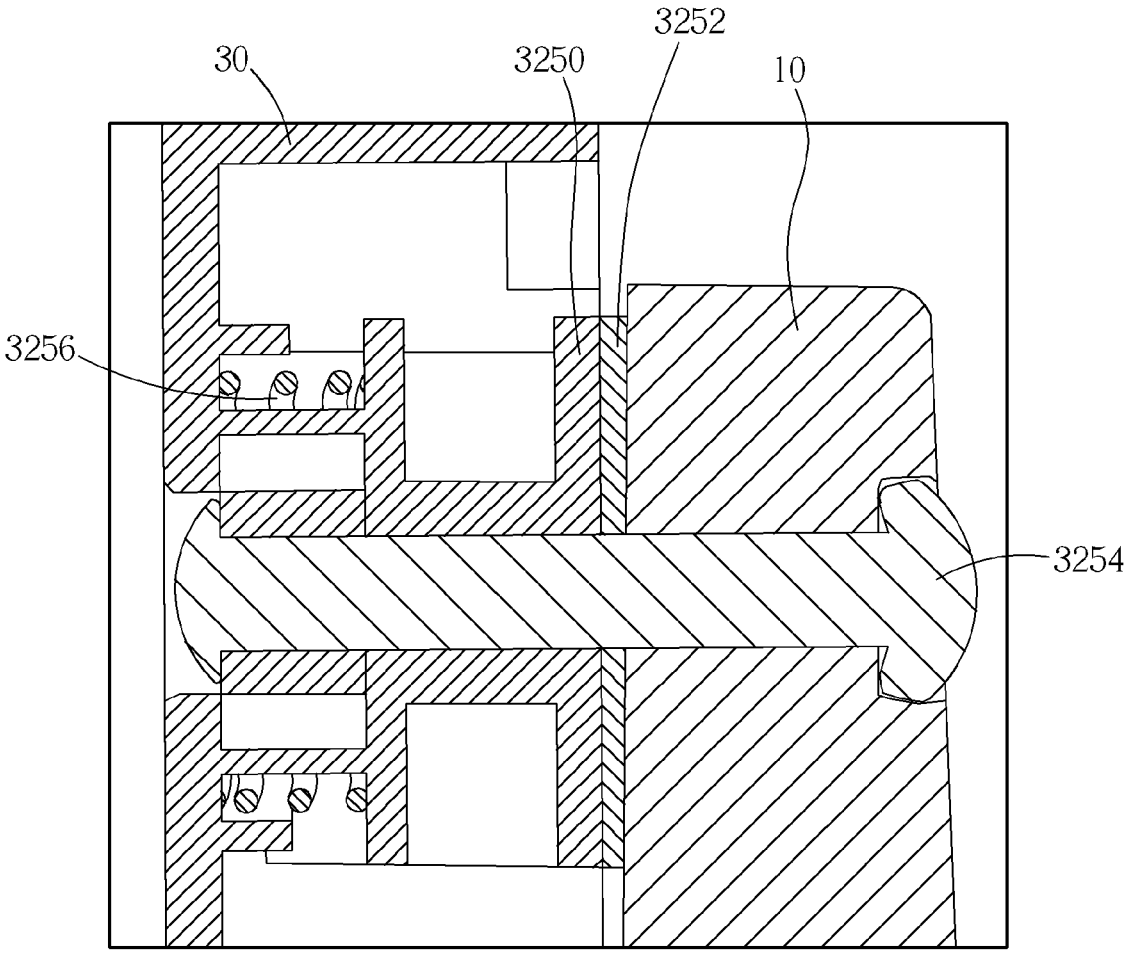
FIG. 15 is a sectional view illustrating the seat pivotally connected to the second fixing socket.

In another embodiment, the invention may dispose the aforesaid first fixing socket 14 on one side of the seat frame 12 and dispose a second fixing socket 30 (as shown in FIG. 12) on the other side of the seat frame 12 opposite to the first fixing socket 14. In this embodiment, the aforesaid highchair 1 may further comprise a driving mechanism 32, as shown in FIGS. 13 to 15. The first fixing socket 14 is pivotally connected to one side of the seat 10 and the driving mechanism 32 is pivotally connected to the other side. The driving mechanism 32 is disposed in the second fixing socket 30. When the restraining member 18 is located in the sliding groove 140 and the fixing member 24 locks the adjusting member 22, the driving mechanism 32 can drive the seat 10 to swing with respect to the seat frame 12 automatically.

As shown in FIG. 13, the second fixing socket 30 has an accommodating space 300, a plurality of power supply units 320 (as the batteries shown in FIG. 13) of the driving mechanism 32 are disposed in the accommodating space 300, and a cover 322 of the driving mechanism 32 detachably covers the accommodating space 300. As shown in FIG. 14, the driving mechanism 32 further comprises a driving device 324. The driving device 324 comprises a motor 3240, a flywheel 3242, a worm shaft 3244, a worm gear 3246, a linking rod 3248, a friction member 3250, a rubber member 3252, a rivet member 3254, a fourth resilient member 3256 and a switch 3258. An output axle of the motor 3240 is connected to the flywheel 3242. The flywheel 3242 is connected to the worm shaft 3244. The worm shaft 3244 is connected to the worm gear 3246. One end of the linking rod 3248 is connected to the worm gear 3244 and the other end is connected to the friction member 3250. The seat 10 is pivotally connected to the second fixing socket 30 by the rivet member 3254. The friction member 3250 and the rubber member 3252 are disposed on the rivet member 3254. The friction member 3250 contacts the rubber member 3252 tightly and the rubber member 3252 contacts the seat 10 tightly. The fourth resilient member 3256 is disposed between the second fixing socket 30 and the friction member 3250. In this embodiment, the fourth resilient member 3256 can be a spring. The switch 3258 has an operating portion 3260 exposed out of the second fixing socket 30.

When the restraining member 18 is located in the sliding groove 140 and the fixing member 24 engages with the adjusting member 22, the user can operate the operating portion 3260 of the switch 3258 to turn on power of the driving device 324. At this time, the motor 3240 is actuated to drive the flywheel 3242, the worm shaft 3244, the worm gear 3246 and the linking rod 3248 to rotate. At the same time, the linking rod 3248 drives the friction member 3250 to rotate around the rivet member 3254. Since the friction member 3250 contacts the rubber member 3252 tightly, a friction between the friction member 3250 and the rubber member 3252 is generated during the rotation of the friction member 3250. Furthermore, since the rubber member 3252 also contacts the seat 10 tightly, the aforesaid friction will be converted into a motive force to make the seat 10 swing back and forth. When the user operate the operating portion 3260 of the switch 3258 to turn off power of the driving device 324, the friction between the rubber member 3252 and the seat 10 will stop the seat 10 gradually.

As shown in FIG. 15, the fourth resilient member 3256 can provide an elastic force for making the friction member 3250 contact the rubber member 3252 tightly, so as to make the rubber member 3252 contact the seat 10 tightly. Furthermore, when there is a specific friction between the rubber member 3252 and the seat 10, the fourth resilient member 3256 may increase the friction.

Figure 16:
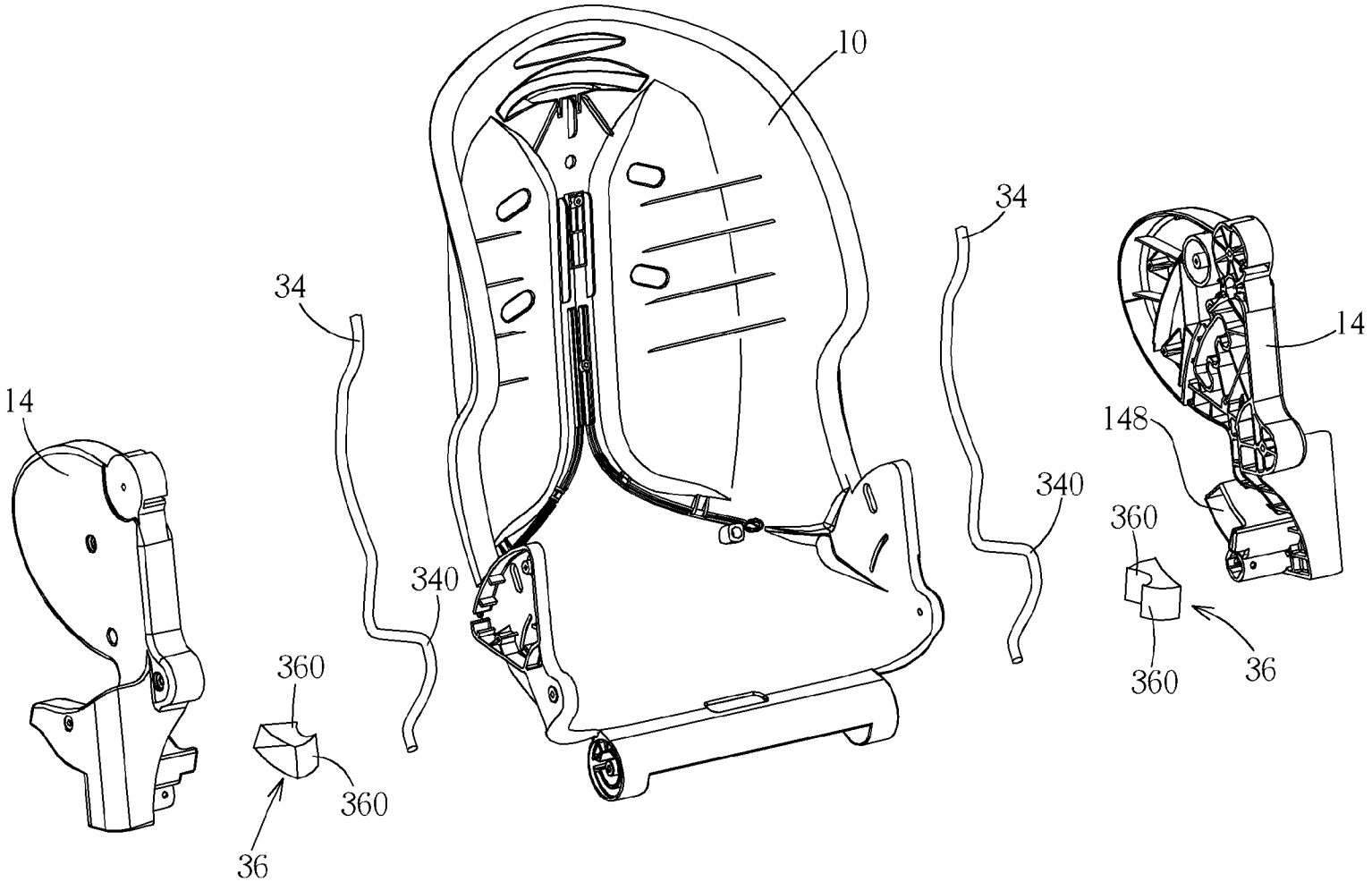
FIG. 16 is an exploded view illustrating another embodiment of the invention.
Figure 17:
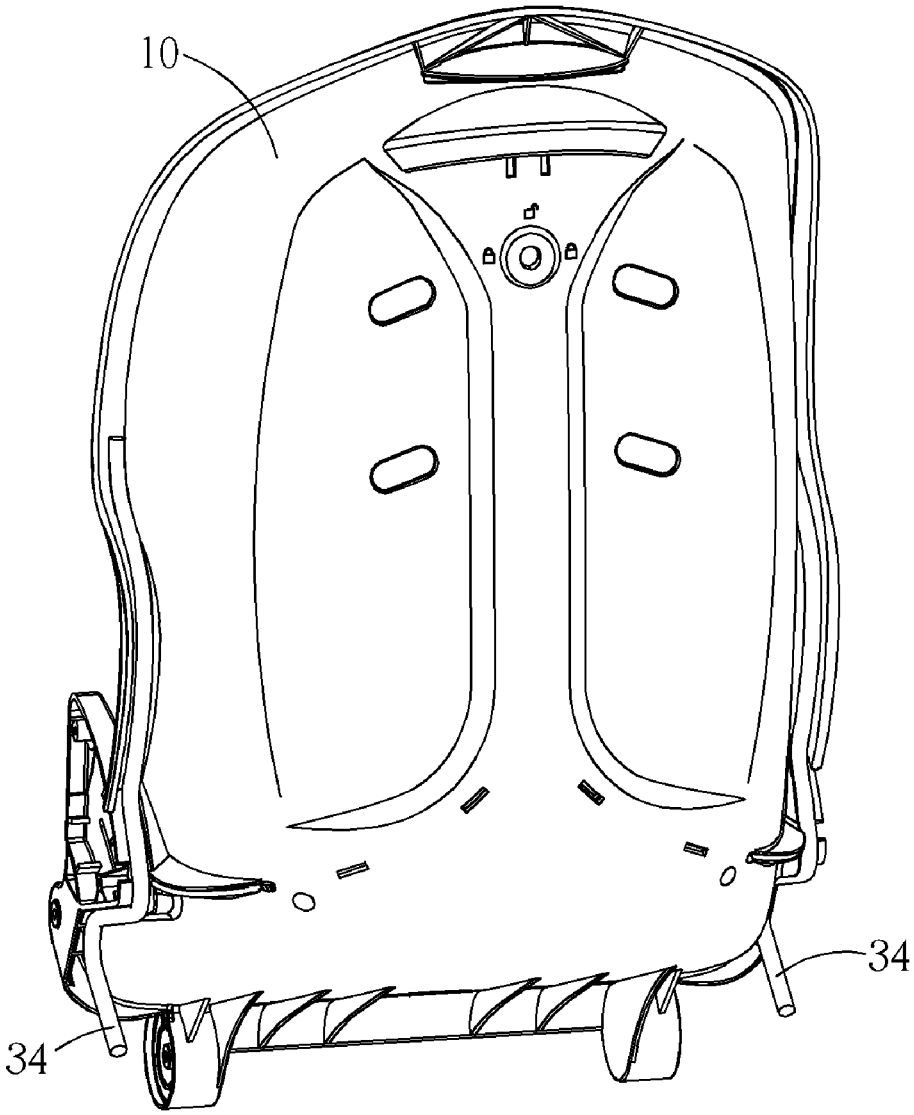
FIG. 17 is a perspective view illustrating the second resilient member disposed on the seat.
Figure 18:
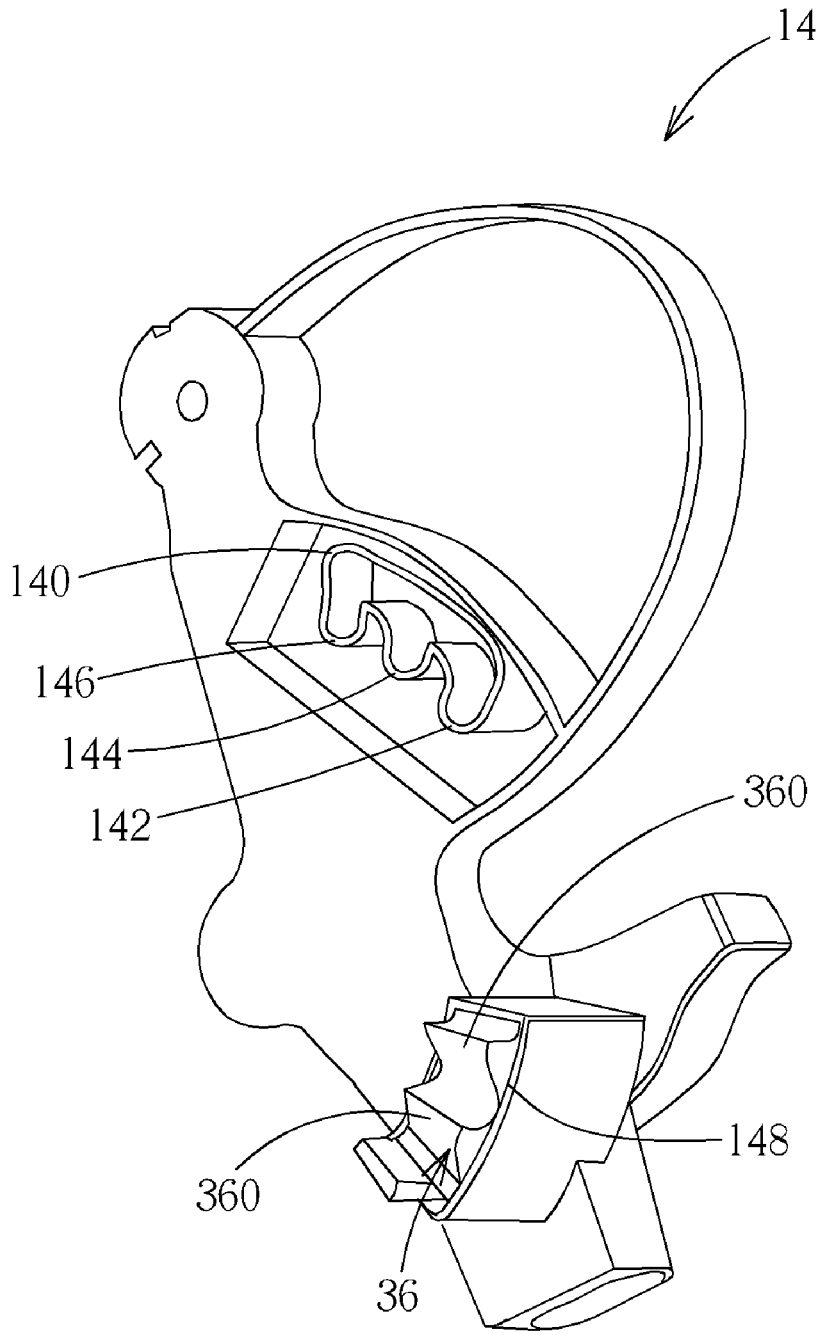
FIG. 18 is a perspective view illustrating the first fixing socket shown in FIG. 16.
Figure 19:
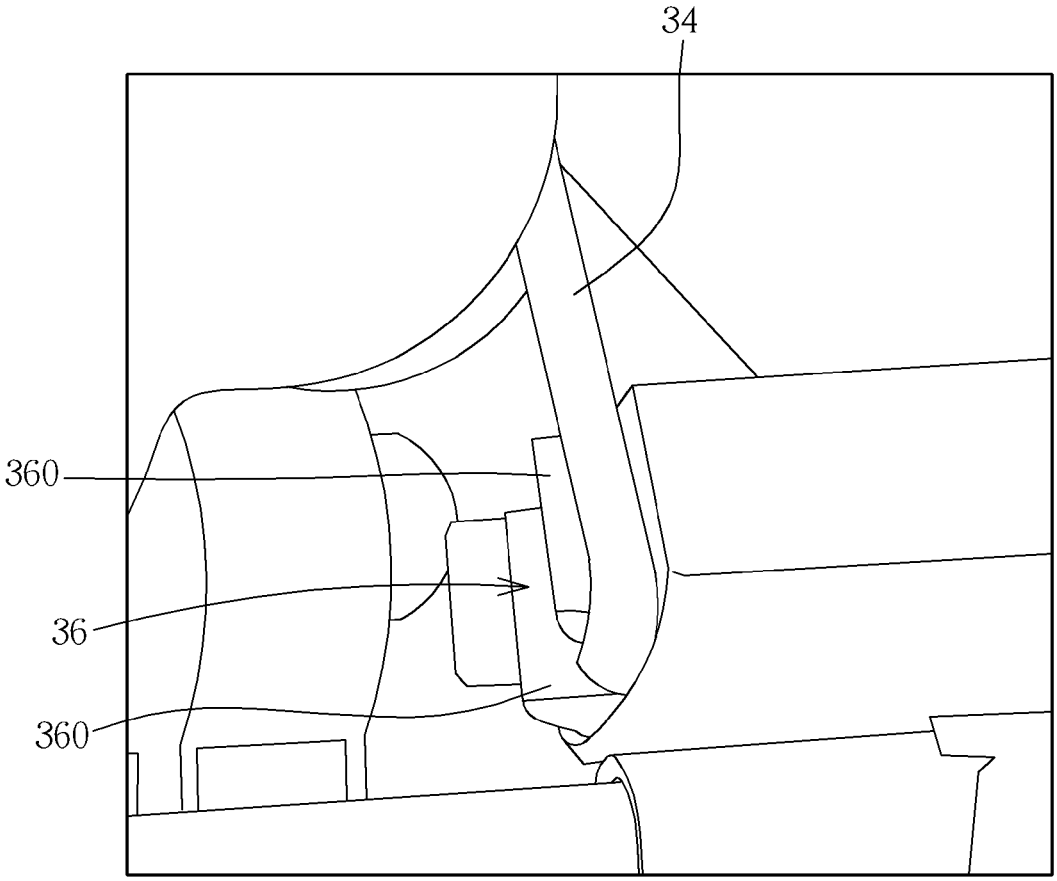
FIG. 19 is a perspective view illustrating the second resilient member abutting against the locking member.

In another embodiment, the highchair 1 of the invention may further comprise a second resilient member 34 and a locking member 36. As shown in FIGS. 16 and 17, two second resilient members 34 are disposed on opposite sides of the seat 10. Each second resilient member 34 has a bending portion 340. In this embodiment, the second resilient member 34 can be an iron wire or other deformable components. As shown in FIG. 18, the locking member 36 is movably disposed in a recess 148 of the first fixing socket 14. As shown in FIG. 19, when the locking member 36 protrudes from the recess 148, one end of the second resilient member 34 abuts against the locking member 36 and the other end abuts against the seat 10. When the seat 10 is pressed down by an external force, the bending portion 340 of the second resilient member 34 is bent due to the external force. After releasing the external force, the bending portion 340 of the second resilient portion 34 provides an elastic force for bouncing the seat 10. In this embodiment, the locking member 36 may has a plurality of abutting portions 360. When the seat 10 is situated at one specific position relative to the seat frame 12, one end of the second resilient member 34 abuts against one of the abutting portions 360.

Figure 20:
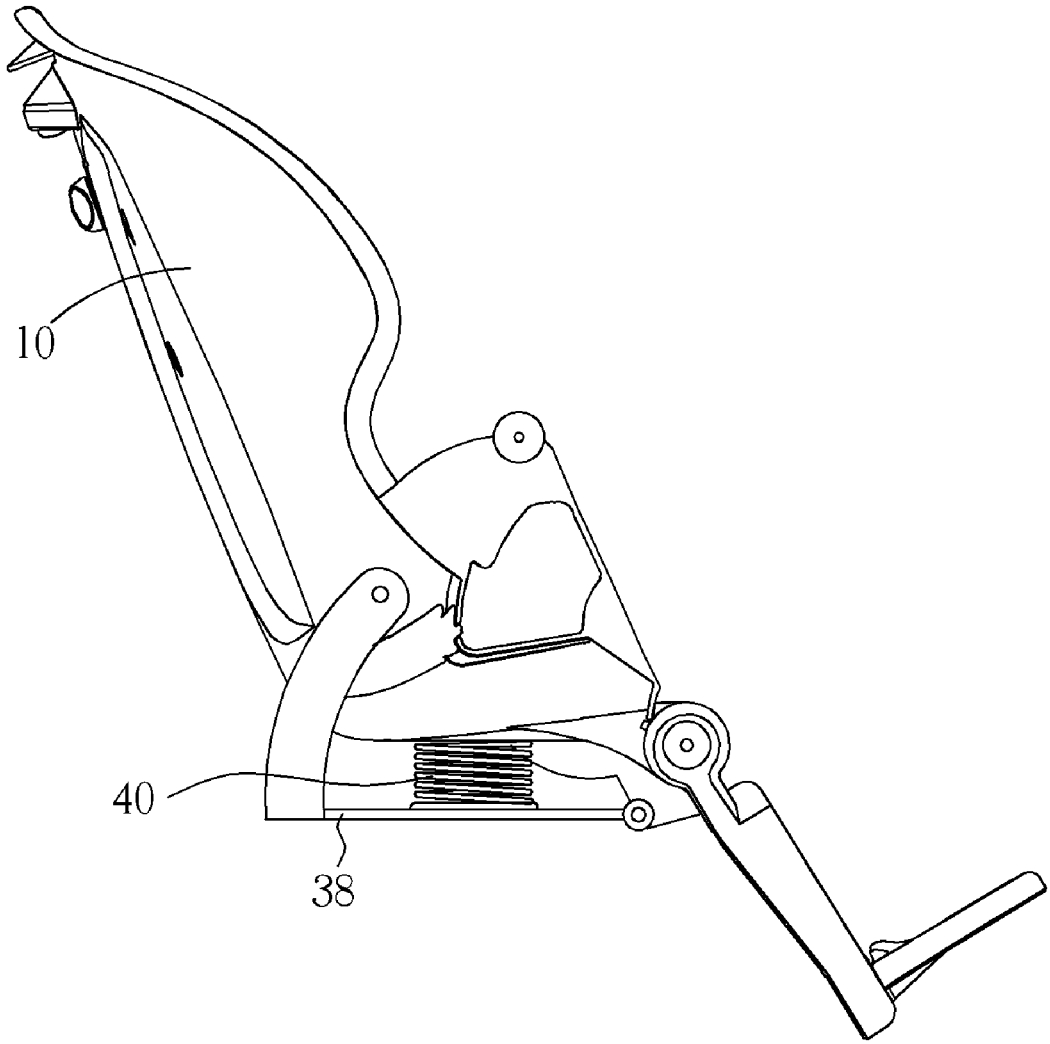
FIG. 20 is a side view illustrating another embodiment of the invention.

In another embodiment, the highchair 1 of the invention may further comprise a bottom plate 38 and a third resilient member 40. As shown in FIG. 20, the bottom plate 38 is disposed below the seat 10 and connected to the seat frame 12, and the third resilient member 40 is disposed between the seat 10 and the bottom plate 38. When the seat 10 is pressed down by an external force, the third resilient member 40 is compressed due to the external force. After releasing the external force, the third resilient member 40 provides an elastic force for bouncing the seat 10. In this embodiment, the third resilient member 40 can be a spring.

According to the aforesaid embodiments, the highchair of the invention has the following advantages and useful effects. The adjusting member can be operated to make the restraining member selectively engage with the first, second or third engaging groove, so as to adjust the tilt angle of the seat. Furthermore, when the restraining member is disengaged from the first, second or third engaging groove and the fixing member locks the adjusting member, the restraining member can slide within the sliding groove, such that the seat can swing with respect to the seat frame. It should be noted that the seat can be swung manually or automatically by the driving device. Moreover, the second or third resilient member can provide elastic force for bouncing the seat. Therefore, the highchair of the invention can perform multiple functions, such as seat swing, seat bouncing and/or seat tilt angle adjusting function(s), so as to pacify an infant or child or seat him or her at appropriate position.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A highchair comprising:

a seat frame;

a first fixing socket disposed on the seat frame, the first fixing socket having a sliding groove and a first engaging groove, the sliding groove communicating with the first engaging groove;

a seat pivotally connected to the first fixing socket;

an adjusting member movably disposed on the seat and having a first fixing portion;

a fixing member rotatably disposed on the seat and having a second fixing portion, the fixing member being capable of selectively engaging with the adjusting member by an engagement between the first fixing portion and the second fixing portion;

a pivoting member pivotally connected to one side of the seat;

a connecting member, a first end of the connecting member being connected to the pivoting member and a second end of the connecting member being connected to the adjusting member; and a restraining member disposed at one end of the pivoting member and movably engaged with the first engaging groove;

wherein when the adjusting member is pulled, the adjusting member drives the connecting member to pull the pivoting member and then the pivoting member rotates with respect to the seat, so as to drive the restraining member to move from the first engaging groove to the sliding groove; and wherein when the restraining member is disengaged from the first engaging groove and the adjusting member is positioned by the engagement between the first fixing portion and the second fixing portion, the restraining member is capable of sliding within the sliding groove, such that the seat is capable of swinging with respect to the seat frame.

2. The highchair of claim 1, wherein the first fixing socket has a second engaging groove communicating with the sliding groove, and the restraining member is able to move from the first engaging groove and the sliding groove to the second engaging groove by operating the adjusting member.

3. The highchair of claim 2, further comprising a first resilient member disposed between the seat and the pivoting member, wherein when the adjusting member is released from the fixing member, the first resilient member provides an elastic force for the pivoting member, such that the pivoting member drives the restraining member to move toward the first or second engaging groove.

4. The highchair of claim 1, further comprising a torsion spring disposed on the first fixing socket, wherein a first end of the torsion spring abuts against the first fixing socket and a second end of the torsion spring abuts against the seat.

5. The highchair of claim 1, wherein the seat has a restraining groove and one end of the restraining member is movably disposed in the restraining groove.

6. The highchair of claim 1, further comprising a second resilient member and a locking member disposed on one side of the seat, the locking member being movably disposed in a recess of the first fixing socket, wherein when the locking member protrudes from the recess, one end of the second resilient member abuts against the locking member, such that the second resilient member provides an elastic force for bouncing the seat.

7. The highchair of claim 6, wherein the locking member has a plurality of abutting portions, when the seat is situated at one position relative to the seat frame, one end of the second resilient member abuts against one of the abutting portions.

8. The highchair of claim 1, further comprising a bottom plate and a third resilient member, the bottom plate being disposed below the seat, the third resilient member being disposed between the seat and the bottom plate, and the third resilient member providing an elastic force for bouncing the seat.

9. The highchair of claim 1, further comprising a second fixing socket and a driving mechanism, the second fixing socket being disposed on one side of the seat frame and opposite to the first fixing socket, the seat being pivotally connected to the driving mechanism, the driving mechanism being disposed in the second fixing socket, wherein when the restraining member is disengaged from the first engaging groove and the fixing member locks the adjusting member, the driving mechanism is capable of driving the seat to swing with respect to the seat frame.

10. The highchair of claim 9, wherein the driving mechanism comprises a driving device, the driving device comprises a motor, a flywheel, a worm shaft, a worm gear, a linking rod, a friction member, a rubber member and a rivet member, an output axle of the motor is connected to the flywheel, the flywheel is connected to the worm shaft, the worm shaft is connected to the worm gear, a first end of the linking rod is connected to the worm gear and a second end of the linking rod is connected to the friction member, the seat is pivotally connected to the second fixing socket by the rivet, the friction member and the rubber member are disposed on the rivet, the friction member contacts the rubber member tightly, and the rubber member contacts the seat tightly.

11. The highchair of claim 10, wherein the driving device comprises a fourth resilient member disposed between the second fixing socket and the friction member, and the fourth resilient member provides an elastic force for making the friction member contact the rubber member tightly.

12. A highchair comprising:

a seat frame;

a fixing socket disposed on the seat frame, the fixing socket having a sliding groove and a first engaging groove, the sliding groove communicating with the first engaging groove;

a seat pivotally connected to the fixing socket;

an adjusting member movably disposed on the seat and having a first fixing portion;

a fixing member disposed on the seat and having a second fixing portion, the fixing member being capable of selectively engaging with the adjusting member by an engagement between the first fixing portion and the second fixing portion; and a restraining member disposed on the seat and movably engaged with the first engaging groove;

wherein when the adjusting member is pulled, the adjusting member drives the restraining member to move from the first engaging groove to the sliding groove; and wherein when the restraining member is disengaged from the first engaging groove and the adjusting member is positioned by the engagement between the first fixing portion and the second fixing portion, the restraining member is capable of sliding within the sliding groove, such that the seat is capable of swinging with respect to the seat frame.

13. The highchair of claim 12, further comprising a pivoting member pivotally connected to one side of the seat and a connecting member connected between the pivoting member and the adjusting member.

14. The highchair of claim 13, wherein the fixing socket has a second engaging groove communicating with the sliding groove, and the restraining member is able to move selectively to one of the first engaging groove and the second engaging groove by operating the adjusting member.

15. The highchair of claim 14, further comprising a first resilient member disposed between the seat and the pivoting member, wherein when the adjusting member is released, the first resilient member provides an elastic force for the pivoting member, such that the pivoting member drives the restraining member to move toward one of the first engaging groove and the second engaging groove.

16. The highchair of claim 12, further comprising a torsion spring disposed on the fixing socket, wherein a first end of the torsion spring abuts against the fixing socket and a second end of the torsion spring abuts against the seat.

17. The highchair of claim 12, wherein the seat has a restraining groove and one end of the restraining member is movably disposed in the restraining groove.

18. The highchair of claim 12, further comprising a second resilient member and a locking member disposed on one side of the seat, the locking member being movably disposed in a recess of the fixing socket, wherein when the locking member protrudes from the recess, one end of the second resilient member abuts against the locking member, such that the second resilient member provides an elastic force for bouncing the seat.

* * * * *